US010221858B2

(12) United States Patent
Berenyi et al.

(10) Patent No.: US 10,221,858 B2
(45) Date of Patent: Mar. 5, 2019

(54) IMPELLER BLADE MORPHOLOGY

(71) Applicant: Rolls-Royce Corporation, Indianapolis, IN (US)

(72) Inventors: Steven Tibor Berenyi, Indianapolis, IN (US); Wayne D. Koester, Brownsburg, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 311 days.

(21) Appl. No.: 14/991,424

(22) Filed: Jan. 8, 2016

(65) Prior Publication Data

US 2017/0198712 A1 Jul. 13, 2017

(51) Int. Cl.
*F04D 29/30* (2006.01)
*F04D 29/28* (2006.01)

(52) U.S. Cl.
CPC ..... *F04D 29/30* (2013.01); *F04D 29/284* (2013.01)

(58) Field of Classification Search
CPC ..... F04D 29/30; F04D 29/32; F04D 29/321; F04D 29/24; F04D 29/242; F04D 29/284
See application file for complete search history.

(56) References Cited

U.S. PATENT DOCUMENTS

| | | | | |
|---|---|---|---|---|
| 4,543,041 | A * | 9/1985 | French | F04D 29/30 416/183 |
| 7,563,074 | B2 | 7/2009 | Xu | |
| 7,686,586 | B2 | 3/2010 | Nikpour | |
| 8,241,005 | B2 | 8/2012 | Emmerson et al. | |
| 8,297,922 | B2 | 10/2012 | Cruickshank | |
| 8,794,914 | B2 | 8/2014 | Hommes et al. | |
| 8,915,711 | B2 | 12/2014 | Billotey et al. | |
| 8,951,009 | B2 | 2/2015 | Swiatek et al. | |
| 9,033,667 | B2 | 5/2015 | Iwakiri et al. | |
| 9,033,668 | B2 | 5/2015 | Bronfeld et al. | |
| 2009/0041585 | A1 * | 2/2009 | Hwang | F04D 29/30 416/236 R |
| 2013/0266450 | A1 | 10/2013 | Tomita et al. | |
| 2014/0294582 | A1 | 10/2014 | Fujioka | |
| 2015/0159670 | A1 | 6/2015 | Saito | |

FOREIGN PATENT DOCUMENTS

| | | |
|---|---|---|
| FR | 3062431 | 1/2018 |
| WO | WO 2018/138438 | 8/2018 |

* cited by examiner

*Primary Examiner* — Jason D Shanske
*Assistant Examiner* — Maxime M Adjagbe
(74) *Attorney, Agent, or Firm* — McCracken & Gillen LLC

(57) ABSTRACT

According to one aspect, an impeller comprises a hub and a plurality of blades extending from the hub. At least one blade includes a curved root portion proximal the hub, a curved tip portion disposed at an outer blade location, and a mid-portion intermediate the root portion and the tip portion. The mid-portion is substantially linear.

20 Claims, 6 Drawing Sheets

IMPELLER BLADE MORPHOLOGY

FIELD OF DISCLOSURE

The present subject matter relates to rotating machinery, and more particularly, to impellers.

BACKGROUND

Centrifugal compressors are used to compress a fluid, such as air, and are a part of turbomachines, turbochargers, water pumps, and other applications where compressing a fluid is useful. Centrifugal compressors include an impeller and a shroud that encloses the impeller. Fluid enters the centrifugal compressor at an inlet and is expelled at an outlet. The impeller, which includes a plurality of blades extending from a hub, rotates to accelerate the fluid. The pressure associated with the fluid increases as the fluid is accelerated by the blades and as the fluid contacts the shroud. Thus, low pressure fluid that enters the inlet of the centrifugal compressor is converted to high pressure fluid at the outlet because of the rotational energy of the impeller.

One problem with currently available centrifugal compressors is that fluid within the centrifugal compressor is typically not efficiently compressed by the impeller. There is a gap between the outermost extent of the impeller blades and the shroud, and the fluid in this gap is not efficiently compressed by the impeller blades. Also, fluid proximal the hub of the impeller is not efficiently compressed by the impeller blades. These inefficiencies arise from the fact that fluid in the gap and fluid proximal the hub may churn or shear instead of compressing efficiently. This lack of efficiency in compressing fluid results in decreased performance and higher fuel costs.

SUMMARY

According to one aspect, an impeller comprises a hub and a plurality of blades extending from the hub. At least one blade includes a curved root portion proximal the hub, a curved tip portion disposed at an outer blade location, and a mid-portion intermediate the root portion and the tip portion. The mid-portion is substantially linear.

According to another aspect, an impeller comprises a hub and a plurality of blades extending from the hub. Each blade includes a root portion proximal the hub, a tip portion disposed at an outer blade location, and a mid-portion intermediate the root portion and the tip portion. The mid-portion is substantially linear. A root edge of the root portion is disposed a first lateral distance from a line defined by the mid-portion and a tip edge of the tip portion is disposed a second lateral distance from the line defined by the mid-portion.

According to yet another aspect, an impeller comprises a hub and a plurality of blades extending from the hub. At least one blade includes a curved root portion proximal the hub, a curved tip portion disposed at an outer blade location, and a mid-portion intermediate the root portion and the tip portion. The mid-portion is substantially linear. The curved tip portion is curved such that a tip edge of the curved tip portion is disposed at a lateral distance in an approximately circumferential direction with respect to an axis of rotation of the impeller.

Other aspects and advantages will become apparent upon consideration of the following detailed description and the attached drawings wherein like numerals designate like structures throughout the specification.

DETAILED DESCRIPTION

Figure 1:
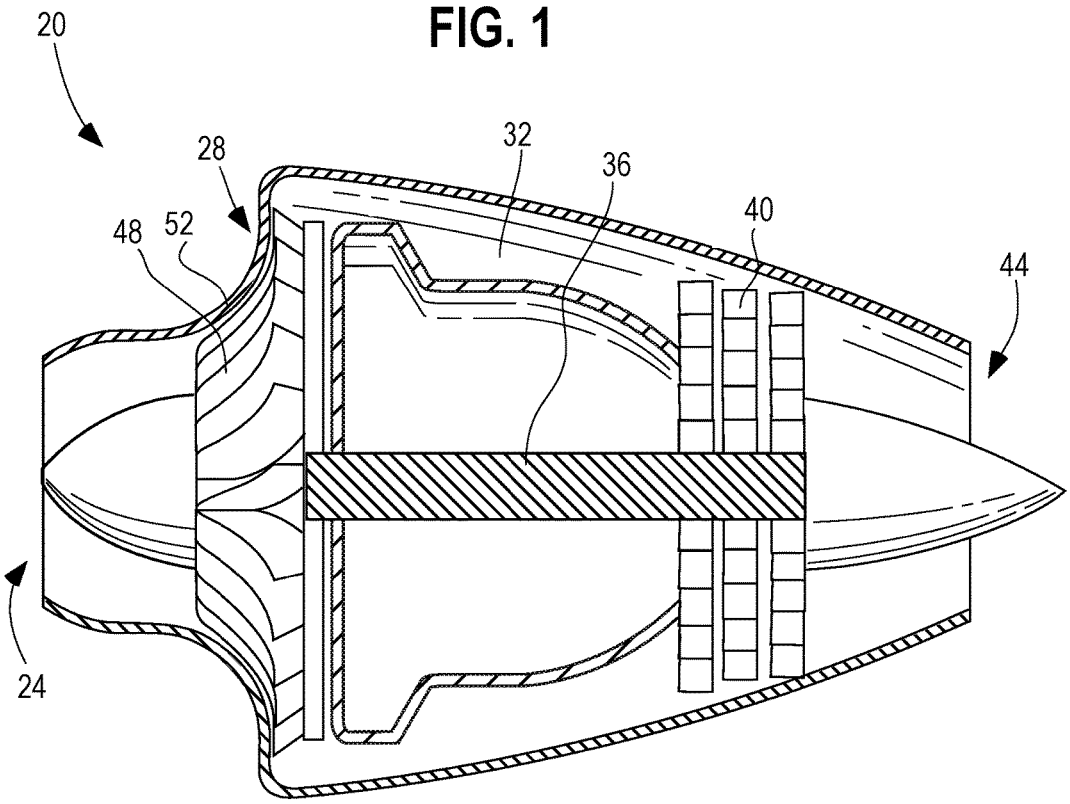
FIG. 1 is a diagrammatic side view, partially in section, of an exemplary rotating machine in the form of a gas turbine engine that includes a centrifugal compressor.

Referring now to FIG. 1, an exemplary rotating machine in the form of a gas turbine engine 20 includes an intake 24, a centrifugal compressor 28, a combustion chamber 32 that receives compressed air from the compressor 28, a shaft 36, a turbine 40 that converts rapidly expanding combusting fuel and air into rotary motive power, and an exhaust 44. The compressor 28 includes an impeller 48 and a shroud 52 that encloses the impeller 48 as further shown in FIG. 1.

It should be noted that the embodiments disclosed herein may be used in or with any rotating machinery having a centrifugal compressor, including the illustrated gas turbine engine, or other turbomachinery including a turbofan engine, a turbojet engine, a turboshaft engine, a jet prop engine, etc., as well as non-turbomachinery such as a water pump, a turbocharger, a heating/cooling compressor, or the like. Also, it should be noted that the embodiments disclosed herein may be used with any fluid, including air, as illustrated.

Figure 2:
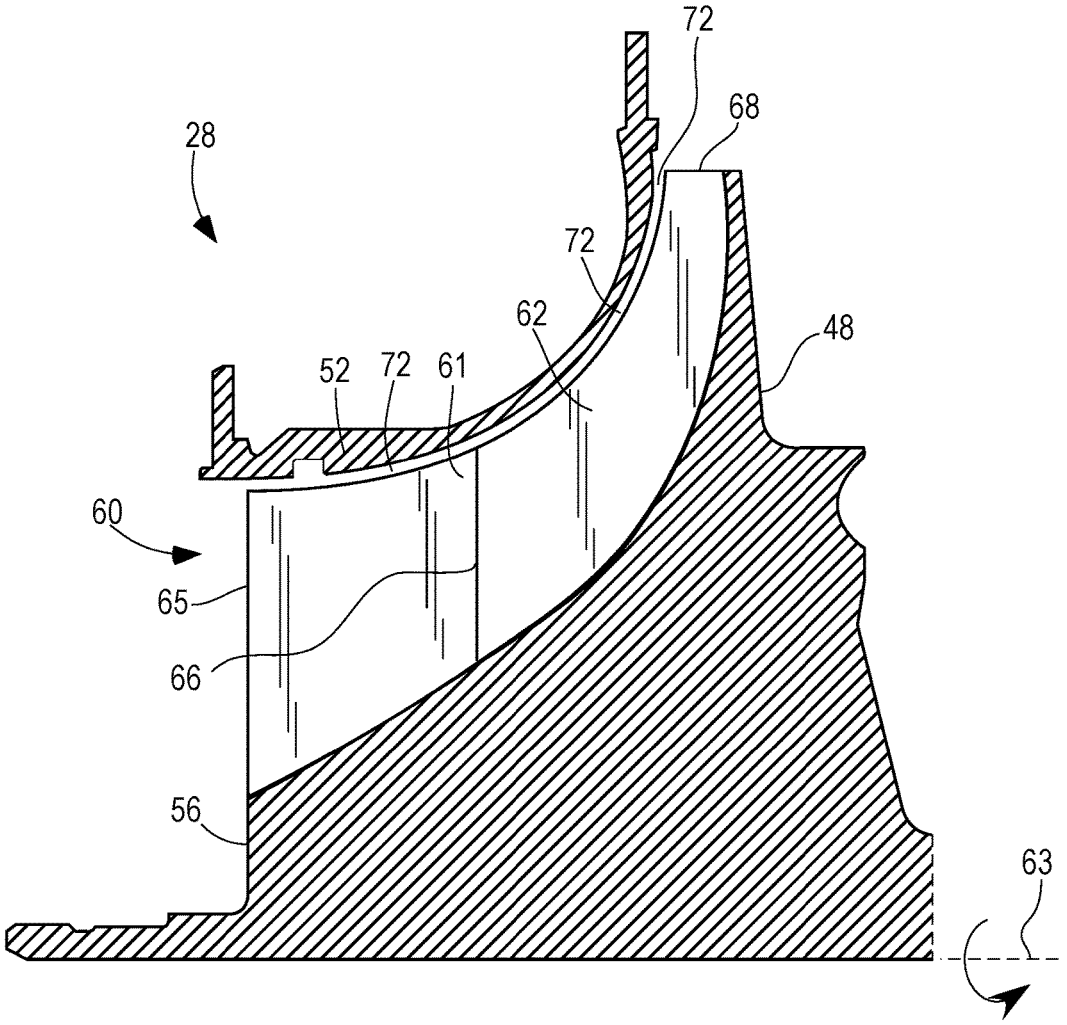
FIG. 2 PRIOR ART
FIG. 2 is a fragmentary enlarged cross sectional view of a portion of a centrifugal compressor that comprises a prior art impeller and a shroud and that is used in a rotating machine such as the rotating machine of FIG. 1.
Figure 3:
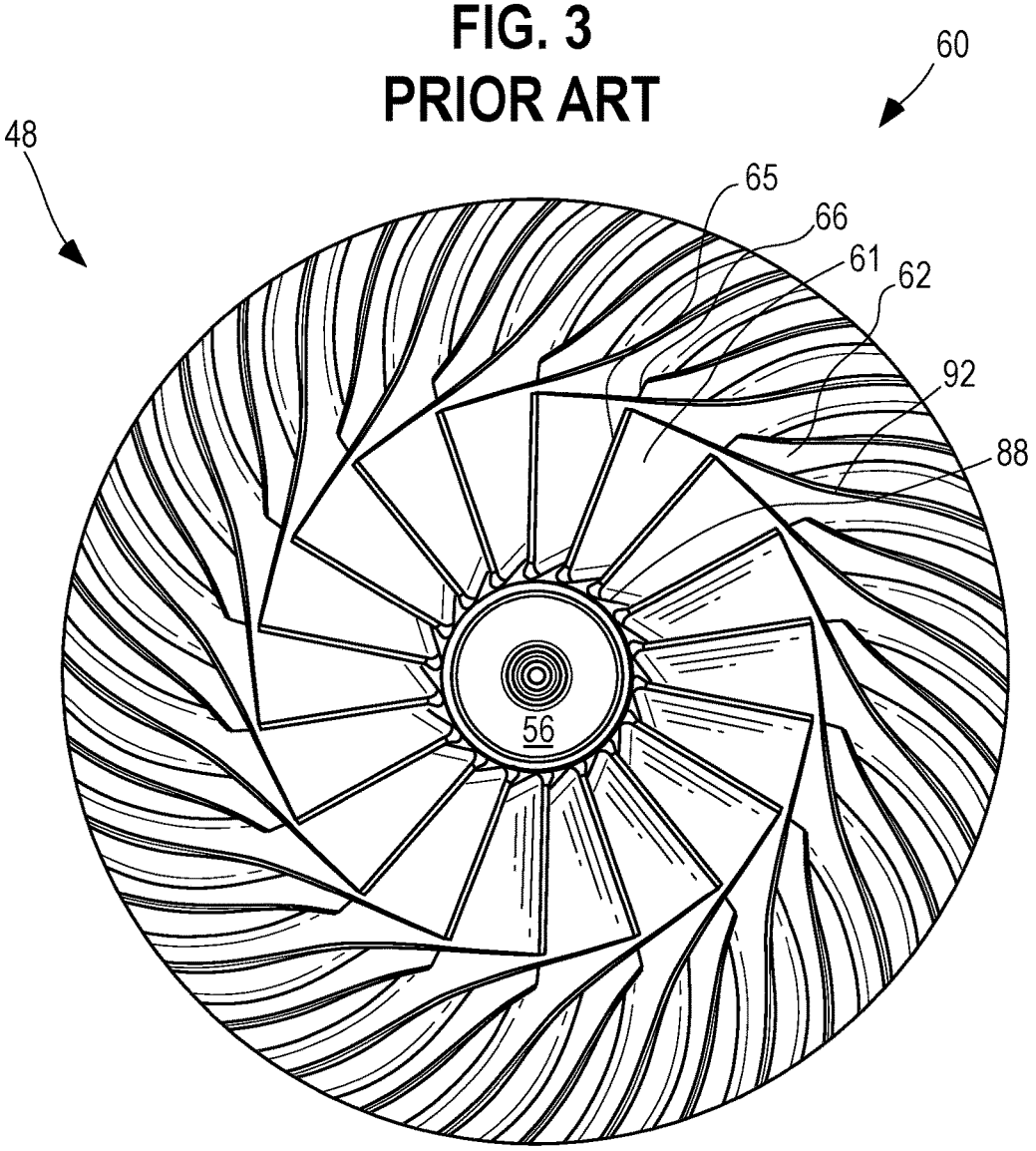
FIG. 3 PRIOR ART
FIG. 3 is a front elevational view of a prior art impeller wherein blades have a substantially linear inlet edge.
Figure 5:
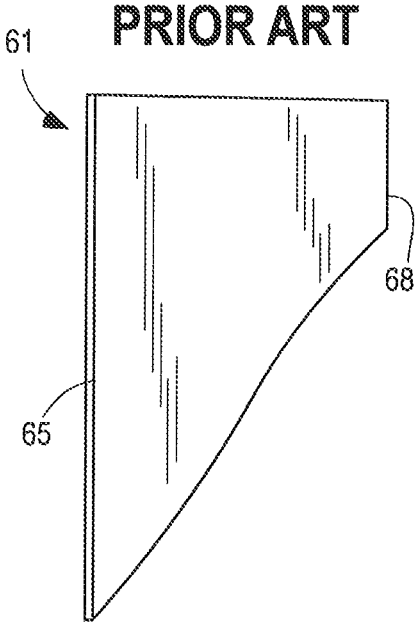
FIG. 5 PRIOR ART
FIG. 5 is a perspective view of a blade used in the prior art impeller of FIG. 3.

Referring now to FIGS. 2, 3, and 5, the impeller 48, which as shown is known in the prior art, includes a hub 56 and a plurality of blades 60 extending from the hub 56. The plurality of blades 60 includes a set of full blades 61 and a set of splitter blades 62 disposed between the full blades 61. During operation, the impeller 48 rotates about a rotational axis 63 concentric with the shaft 36 of the engine 20 and air enters the compressor 28 proximal inlet edges 65 of the full blades 61. The splitter blades 62 have inlet edges 66 farther downstream than the inlet edges 65 of the full blades 61. Air exits in a radial or centrifugal direction proximal outlet edges 68 of the blades 60.

Figure 4:
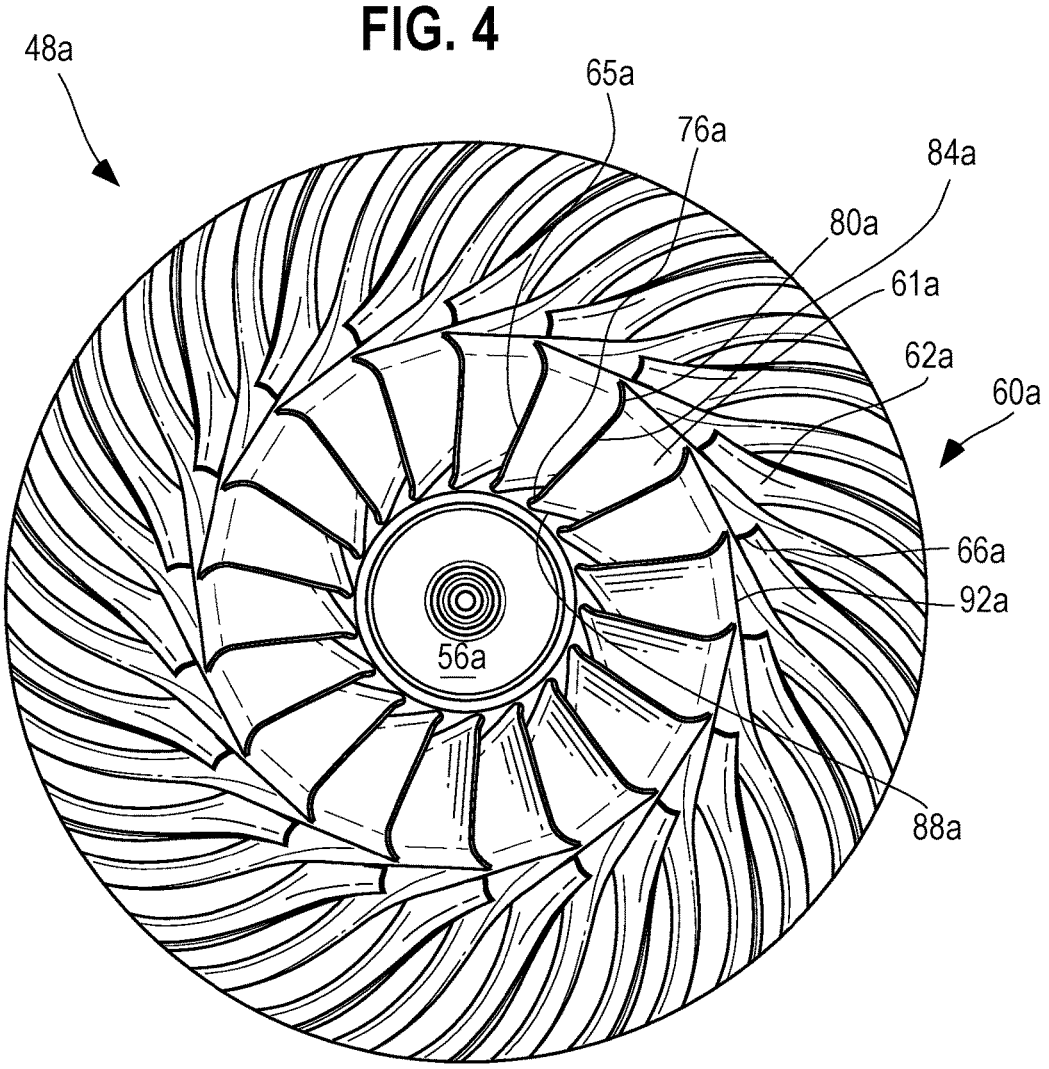
FIG. 4 is a front elevational view of an impeller wherein at least one of the blades includes a curved root portion, a curved tip portion, and a substantially linear mid-portion.
Figure 6:
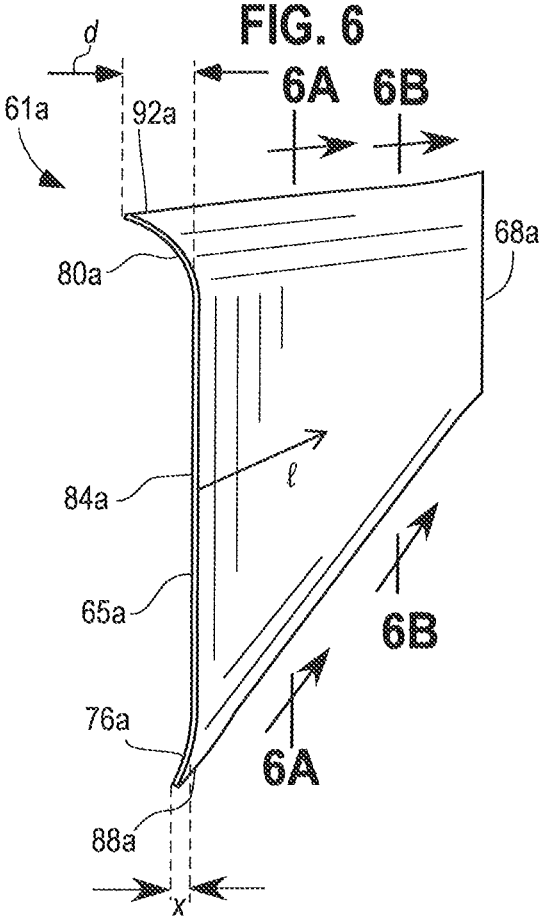
FIG. 6 is a perspective view of a blade used in the impeller of FIG. 4.

The compressor 28 includes a gap 72 between the shroud 52 and an outermost extent of the blades 60. The fluid (i.e., the air) in the gap 72 is not efficiently compressed by the blades 60 during rotation. Also, air proximal the hub 56 is not efficiently compressed by the blades 60. This is because the air in the gap 72 and the air proximal the hub 56 may churn or shear and may not be efficiently incorporated into the working volume of air of the impeller 48, thus limiting performance. FIG. 4 shows a front elevational view of an embodiment of an impeller 48*a* that includes a hub 56*a* and a plurality of blades 60*a* extending from the hub 56*a*. The impeller 48*a* of FIG. 4 may be substituted for the impeller 48 of FIGS. 2, 3, and 5. Portions of the impeller 48*a* that may be different from the impeller 48 may be designated with a suffix such as "a." The plurality of blades 60*a* includes at least one full blade 61*a* that comprises a root portion 76*a* proximal the hub 56*a*, a tip portion 80*a* disposed at an outer blade location, and a mid-portion 84*a* intermediate the root portion 76*a* and the tip portion 80*a*. As shown in FIGS. 4 and 6, the root portion 76*a* is optionally curved, the tip portion 80*a* is optionally curved, and the mid-portion 84*a* is optionally substantially linear. As further shown, the curvature of the root portion 76*a*, the curvature of the tip portion 80*a*, and the linearity of the mid-portion 84*a* extend to portions of the blade 61*a* downstream from the inlet edge 65*a*. In some embodiments, each blade of the plurality of blades 60*a* has the morphology described above. In some embodiments and as shown in FIG. 6, the blade 61*a* includes an outlet edge 68*a* (proximal an exhaust of the impeller 48*a*) that is substantially linear.

During rotation, the curvature of the tip portion 80*a* facilitates a radial airflow that forces low-energy air from the gap 72 toward the mid-portion 84*a*, thus increasing airflow through the mid-portion 84*a*. More specifically, a low-pressure zone is created adjacent and radially inside the tip portion 80*a*. This, in turn, establishes a pressure differential between the relatively higher-pressure air in the gap 72 and the relatively lower-pressure air just inside the tip portion 80*a*, causing air in the gap 72 to be drawn towards the radial zone inside the tip portion 80*a*. The shape of the blade 61*a* causes the drawn-in air from the gap 72 to flow toward the mid-portion 84*a*, where the air can be efficiently compressed. The resulting increase in the working mass of air improves the performance and efficiency of impeller 48*a*.

Moreover, during rotation, the curvature of the root portion 76*a* generates a radial body force that forces low-energy air proximal the hub 56*a* toward the mid-portion 84*a*, thus increasing the work from, and airflow through the compressor 28*a*. In this respect, the curvatures of the root portion 76*a* and the tip portion 80*a* exert a body force on air to move the air from low-energy regions proximal walls defined by the hub 56*a* and the shroud 52 towards the mid-portion 84*a*, where the air can be more efficiently compressed. It should be noted that as there is no air gap at a root of the blade 61*a*, the curvatures associated with the root portion 76*a* and the tip portion 80*a* may be different.

As further shown in FIG. 6 and as a result of the curvature of the root portion 76*a*, an inlet end of a root edge 88*a* of the root portion 76*a* is disposed at a lateral distance x from a line defined by the substantially linear mid-portion 84*a*. Moreover, as a result of the curvature of the tip portion 80*a*, an inlet end of a tip edge 92*a* of the tip portion 80*a* is disposed at a lateral distance d from the line defined by the substantially linear mid-portion 84*a* (e.g., the lateral displacement is in an approximately circumferential direction with respect to the rotation axis 63). As further shown in FIG. 6, the lateral distance d may be greater than the lateral distance x.

Figure 6A:
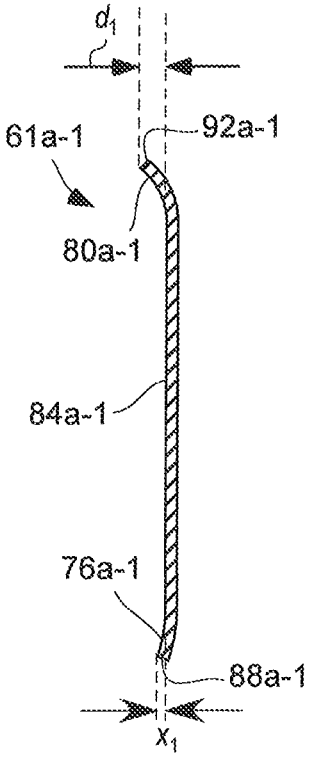
FIG. 6A is a cross sectional view taken generally along the lines 6A-6A of FIG. 6.
Figure 6B:
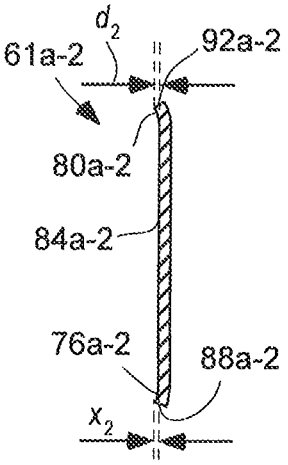
FIG. 6B is a cross sectional view taken generally along the lines 6B-6B of FIG. 6.

FIGS. 6A and 6B show a first portion 61*a*-1 and a second portion 61*a*-2 of the blade 61*a* at cross-sections taken at the lines 6A-6A and 6B-6B, respectively. The first portion 61*a*-1 is disposed between the inlet edge 65*a* and the second portion 61*a*-2 of the blade 61*a*. As shown in FIG. 6A, the first portion 61*a*-1 (e.g., a downstream portion) of the blade 61*a*, includes a first curved tip portion 80*a*-1, a first curved root portion 76*a*-*a*, and a first root edge 88*a*-1 disposed at a lateral distance $x_1$ from a line defined by a first mid-portion 84*a*-1. Further, at the first portion 61*a*-1 of the blade 61*a*, a first tip edge 92*a*-1 of the first curved tip portion 80*a*-1 is disposed at a lateral distance $d_1$ from the line defined by the mid-portion 84*a*-1. As further shown, $d_1$ may be greater than $x_1$. Further, as shown in FIGS. 6 and 6A, d may be greater than $d_1$. As further shown, x may be greater than $x_1$.

Referring now to FIG. 6B, at the second portion 61*a*-2 (e.g., a farther downstream portion) of the blade 61*a*, includes a second curved tip portion 80*a*-2, a second curved root portion 76*a*-2, and a second root edge 88*a*-2 disposed at a lateral distance $x_2$ from a line defined by a second mid-portion 84*a*-2. Further, at the second portion 61*a*-2 of the blade 61*a*, a second tip edge 92*a*-2 of the second curved tip portion 80*a*-2 is disposed at a lateral distance $d_2$ from the line defined by the mid-portion 84*a*-2. Moreover, $d_2$ may be greater than $x_2$. Further, referring now to FIGS. 6A and 6B, $d_1$ may be greater than $d_2$. Further, $x_1$ may be greater than $x_2$.

Although not shown, the blade 61*a* may be linear or curved in the dimension transverse to the cross sections shown in FIGS. 6A and 6B (FIGS. 6A and 6B do not show structures behind the section lines).

In general, the magnitudes of the lateral distances associated with the root edge 88*a* and the tip edge 92*a* may decrease with a distance 1 from the inlet edge 65*a* toward the outlet edge 68*a*. In some embodiments, a rate of decrease of the lateral distances associated with the root edge 88*a* or the tip edge 92*a* may be high (e.g., if a lateral distance x or d at the inlet edge 65*a* is 1 unit, a corresponding lateral distance halfway downstream of the blade 61*a* may be 0.3 units, and a corresponding lateral distance three-quarters of the way downstream of the blade 61*a* may be 0.05 units). Alternatively, the rate of decrease of the lateral distances associated with the root edge 88*a* or the tip edge 92*a* may be low (e.g., if a lateral distance x or d at the inlet edge 65*a* is 1 unit, a corresponding lateral distance halfway downstream of the blade 61*a* may be 0.7 units, and a corresponding lateral distance three-quarters of the way downstream of the blade 61*a* may be 0.3 units).

In some embodiments, a lateral distance associated with the root edge 88*a* may decrease differently from a lateral distance associated with the tip edge 92*a*. Additionally, or alternatively, one or more other parameters associated with curved root portion 76*a* and curved tip portion 80*a* may also decrease with the distance l from the inlet edge 65*a* toward the outlet edge 68*a* (such parameters may comprise radius of curvature associated with the curved root portion 76*a* or the curved tip portion 80*a*, or arc length or angular extent associated with the curved root portion 76*a* or the curved tip portion 80*a*).

Figure 9:
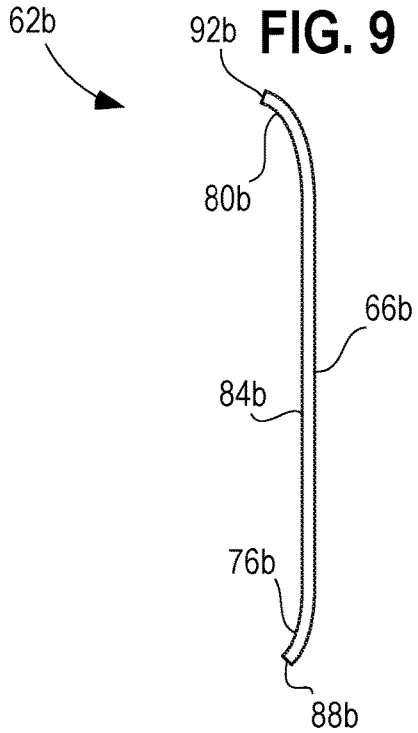
Figure 10:
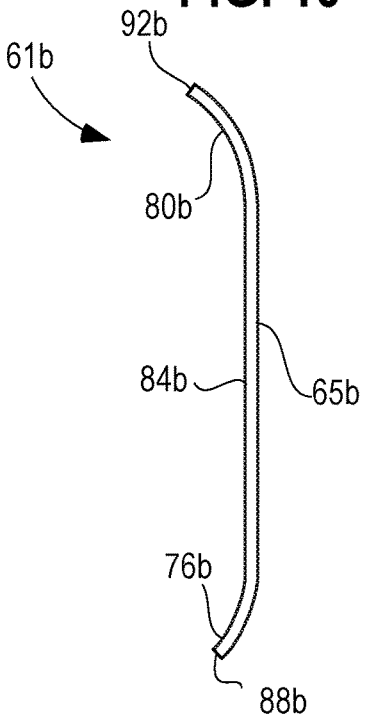

In general, a ratio of lateral distance to total height of an inlet edge is greater for full blades 61*b* than for splitter blades 62*b*. For example, FIG. 9 shows an inlet edge 66*b* of a splitter blade 62*b* and FIG. 10 shows an inlet edge 65*b* of a full blade 61*b* (note that the ratio of either lateral distance x or d to total height is greater for the full blade 61*b* of FIG. 10 than for the splitter blade 62*b* of FIG. 9). In general, the splitter blades 62*b* may have a morphology similar to the full blades 61*a* described above (e.g., in terms of curved root and tip portions and a substantially linear mid-portion, with lateral distances decreasing from inlet edge to outlet edge, and the like) except that the lateral distances associated with the full blades 61*a* may be greater than corresponding lateral distances associated with the splitter blades 62*b*.

Figure 7:
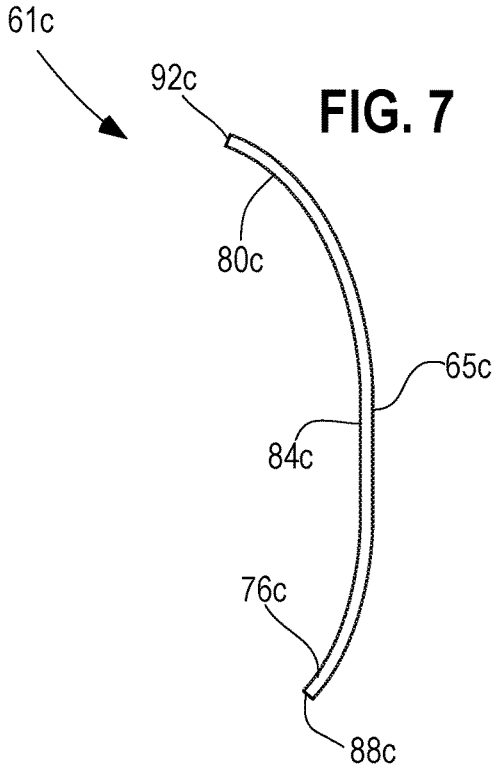
FIGS. 7-10 comprise diagrammatic end elevational views of inlet edges of alternative embodiments of impeller blades.
Figure 8:
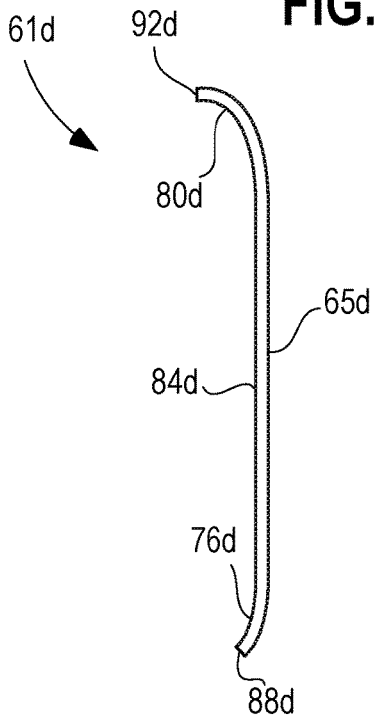

FIGS. 7 and 8 show an inlet edge 65*c* of a larger impeller and an inlet edge 65*d* of a smaller impeller, respectively. As seen in these FIGS., a ratio of a height of a curved tip portion 80*c* or 80*d* to a total height of an inlet edge may be greater for the larger impeller than for the smaller impeller. Also, a ratio of a height of a curved root portion 76*c* or 76*d* to the total height of the inlet edge may be greater for the larger impeller than the smaller impeller. As further shown, a radius of curvature associated with the curved tip portion 80*c* of the larger impeller (FIG. 7) may be greater than a radius of curvature associated with the curved tip portion 80*d* of the smaller impeller. In some embodiments, a ratio of a tip and/or root lateral distance to a height of an inlet edge of a blade increases as a size of an impeller increases.

In some embodiments, besides the size of an impeller, other factors that may affect the morphology of a blade include the type of the impeller, the shape of a shroud, the impeller speed, the pressure ratio, the size of an air gap between the shroud and the impeller, and the flow rate (mass per unit time). Moreover, the blades must be shaped to maintain the overall stability of the impeller under all conditions.

In some embodiments and as shown in FIG. 6, the curved root portion 76*a* of blade 61*a* includes a first portion that may have a first radius of curvature and the curved tip portion 80*a* of blade 61*a* includes a second portion that may have a second radius of curvature. The first and second radii of curvature may be different as further shown or may be the same. In some embodiments, the first radius of curvature may be greater than the second radius of curvature.

Alternatively, and as shown in FIG. 10, a curved root portion 76*b* of an inlet edge 65*b* may have a first portion comprising a compound curve having first and second (and optionally, additional) radii of curvature. Additionally, or alternatively, a curved tip portion 80*b* may include a second portion comprising a compound curve having third and fourth (and optionally, additional) radii of curvature. In some embodiments and as further shown, the first and second radii of curvature may be different from the third and fourth radii of curvature.

INDUSTRIAL APPLICABILITY

In summary, an impeller blade of a particular shape (e.g., having a curved root and tip portion, and a substantially linear mid-portion) guides air from near the shroud and near the hub toward a mid-portion of the blade. This allows the impeller to perform work on a greater mass of air, which increases flow through the compressor, thus increasing efficiency by increasing performance and decreasing fuel costs.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar references in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure. Numerous modifications to the present disclosure will be apparent to those skilled in the art in view of the foregoing description. It should be understood that the illustrated embodiments are exemplary only, and should not be taken as limiting the scope of the disclosure.

We claim:

1. An impeller, comprising:

a hub; and a plurality of blades extending from the hub wherein at least one of the blades includes an inlet edge, first and second curved root portions proximal the hub, first and second curved tip portions disposed spaced away from the first and second root portions, respectively, and first and second linear mid-portions intermediate the first and second root portions and the first and second tip portions, respectively, wherein the first curved tip portion, curved root portion, and mid-portion are associated with a first portion of the blade, the second curved tip portion, curved root portion, and mid-portion are associated with a second portion of the blade, the first portion of the blade is disposed between the inlet edge and the second portion of blade, a first tip edge of the first tip portion is disposed a first lateral distance from a first line defined by the first mid-portion, a second tip edge of the second tip portion is disposed a second lateral distance from a second line defined by the second mid-portion, and the first and second lateral distances are different.

2. The impeller of claim 1, wherein a first root edge of the first curved root portion is disposed a third lateral distance from the first line defined by the first mid-portion, wherein the first lateral distance is different than the third lateral distance.

3. The impeller of claim 2, wherein the third lateral distance is smaller than the first lateral distance.

4. The impeller of claim 1, wherein the second lateral distance is smaller than the first lateral distance.

5. The impeller of claim 1, wherein the plurality of blades includes splitter blades disposed between adjacent full blades.

6. The impeller of claim 1, wherein the first curved root portion includes a first radius of curvature and the first curved tip portion includes a second radius of curvature, wherein the first and second radii of curvature are different.

7. The impeller of claim 6, wherein the first radius of curvature is greater than the second radius of curvature.

8. The impeller of claim 1, wherein the first curved root portion includes a first portion comprising a compound curve associated with a first set of radii of curvature and the second curved tip portion includes a second portion comprising a compound curve associated with a second set of radii of curvature, wherein the first set is different than the second set.

9. An impeller, comprising:

a hub; and a plurality of blades extending from the hub wherein each blade includes first and second root portions proximal the hub, first and second tip portions disposed at an outer blade location, linear first and second mid-portions intermediate the first and second root portions and the first and second tip portions, respectively, and an inlet edge, wherein the first root portion, the first tip portion, and the first mid-portion are spaced away from the inlet edge by a first amount and the second root portion, the second tip portion, and the second mid-portion are spaced away the inlet edge by a second amount, and wherein first and second root edges of the first and second root portions are disposed at first and second lateral distances from first and second lines defined by the first and second mid-portions, respectively, first and second tip edges of the first and second tip portions are disposed at third and fourth lateral distances from first and second lines, respectively, and at least one of (1) the first and second lateral distances are different and (2) the third and fourth lateral distances are different.

10. The impeller of claim 9, wherein each blade of the plurality of blades, comprises a full blade and the impeller further includes splitter blades disposed between adjacent full blades.

11. The impeller of claim 10, wherein at least one of the splitter blades includes a splitter root portion proximal the hub, a splitter tip portion disposed at an outer blade location, and a splitter mid-portion intermediate the splitter root portion and the splitter tip portion, wherein the splitter mid-portion is approximately linear and wherein a root edge of the splitter root portion is disposed at a fifth lateral distance from a line defined by the splitter mid-portion and a tip edge of the splitter tip portion is disposed at a sixth lateral distance from the line defined by the splitter mid-portion.

12. The impeller of claim 11, wherein the third lateral distance is greater than the sixth lateral distance.

13. The impeller of claim 12, wherein the first lateral distance is greater than the fifth lateral distance.

14. The impeller of claim 13, wherein the sixth lateral distance is greater than the fifth lateral distance.

15. The impeller of claim 9, wherein each blade further comprises an outlet edge proximal an exhaust of the impeller, wherein the outlet edge is substantially linear.

16. An impeller, comprising:

a hub; and a plurality of blades extending from the hub wherein at least one of the blades includes an inlet edge, first and second curved root portions proximal the hub, first and second curved tip portions disposed at an outer blade location and spaced away from the first and second root portions, respectively, a first linear mid-portion intermediate the first root portion and first curved tip portion, and a second linear mid-portion intermediate the second root portion and the second curved tip portion, wherein the first and second curved tip portions are curved such that tip edges of the first and second curved tip portions are disposed at first and second lateral distances, respectively, in approximately circumferential directions with respect to an axis of rotation of the impeller, and the first and second lateral distances are different.

17. The impeller of claim 16, wherein a ratio of at least one of the first and second lateral distances to a height of the inlet edge of the at least one blade increases as a size of the impeller increases.

18. The impeller of claim 16, wherein the curved tip portion forms a greater proportion of a height of the at least one blade as a size of the impeller increases.

19. The impeller of claim 16, wherein each curved root portion includes a first portion comprising a first radius of curvature and each curved tip portion includes a second portion comprising a second radius of curvature, wherein the first and second radii of curvature are different.

20. The impeller of claim 19, wherein the first radius of curvature is greater than the second radius of curvature.

* * * * *